United States Patent [19]

Skjold Petersen

[11] Patent Number: 4,906,504

[45] Date of Patent: Mar. 6, 1990

[54] EXTERIOR, WATER-REPELLANT FACING OR COVERING FOR BUILDINGS

[75] Inventor: Jorgen Skjold Petersen, Roskilde, Denmark

[73] Assignee: Rockwool International A/S, Denmark

[21] Appl. No.: 282,132

[22] PCT Filed: Mar. 25, 1988

[86] PCT No.: PCT/DK88/00050

§ 371 Date: Nov. 25, 1988

§ 102(e) Date: Nov. 25, 1988

[87] PCT Pub. No.: WO88/07614

PCT Pub. Date: Oct. 6, 1988

[30] Foreign Application Priority Data

Mar. 25, 1987 [DK] Denmark ..... 1506/87

[51] Int. Cl.[4] ..... B32B 3/02

[52] U.S. Cl. ..... 428/85; 428/141; 428/181; 428/182; 428/703; 428/913; 428/920; 428/284; 428/285

[58] Field of Search ..... 428/288, 114, 141, 232, 428/289, 295, 85, 181, 182, 186, 913, 920, 703, 284, 285

[56] References Cited

U.S. PATENT DOCUMENTS 4,238,257 12/1980 Remi et al. ..... 428/920
4,584,214 4/1986 Eiermann ..... 428/289

FOREIGN PATENT DOCUMENTS 0013682 1/1984 Japan .
1052502 11/1983 U.S.S.R. .

*Primary Examiner*—James J. Bell
*Attorney, Agent, or Firm*—Ostrolenk, Faber, Gerb & Soffen

[57] ABSTRACT

Exterior, water-repellant facing or covering for a roof or a wall. The material is in the form of plates or slabs with overlap or butt joints. The material may include a support web. To eliminate the risk of condensation and to reduce the transmission of heat, the material is formed of mineral wool and a bonding agent. The fibres of the mineral wool lie predominantly within planes which are perpendicular to the external surface of the material.

16 Claims, 1 Drawing Sheet

EXTERIOR, WATER-REPELLANT FACING OR COVERING FOR BUILDINGS

The present invention relates to an exterior, water-repellant facing or covering for buildings for example for roofs or walls in the shape of plates or slabs mounted with overlaps or butt joints on a support with a gradient for drain of rainwater.

Facings or coverings of this type are normally made from hard and compact materials, which are impervious to rain and substantially airtight. Preferred materials are metal, tile, or asbestos cement.

These materials present some drawbacks if an insulating layer is not provided, which is able to prevent large heat transmission or to prevent condensation of humidity on the inside surface of the facing or covering. In storehouses, garages and similar unheated buildings of a simple construction with walls comprising only the layer giving protection against the precipitation condensation of humidity may involve considerable problems, and dripping of condensate may cause serious damage to goods or machinery stored in the building.

The object of the present invention is to provide an exterior facing or covering of the type according to the preamble, in which facing or covering the above drawbacks are eliminated.

According to the invention this object is obtained with a covering or facing which is characterised in that it consists of mineral wool containing a bonding agent, in which mineral wool the direction of the fibers is substantially perpendicular to the external surface.

The invention is based on the observation that mineral wool containing a bonding agent and with the fibers substantially perpendicular to the surface of the mineral wool is repellant to rain and other precipitation. If the fibres are oriented substantially perpendicular to the outer surface of the mineral wool the covering or facing may be considered to be made from transverse-oriented minral wool, and in this position the mineral wool is very resistant to the influence of weathering. The exterior surface may weather in a thickness of a few millimeters, but inside this surface layer the mineral wool will remain intact and preserve its properties, because it is protected by means of the weathered surface layer. As the mineral wool on the other hand is porous and therefor permeable to air and vapour, a condensation cannot take place, and the abovementioned drawbacks of known facings are eliminated. As a consequence it is for example possible to construct a massive covering without a ventilation of the inside of the covering and of for example rafters and battens, which means that the covering or the facing may be included in the insulation of the building. This property also makes the covering impermeable to snow, because there are no ventilated cavities into which the snow may penetrate. The covering as such is also impermeable to snow, as it is possible to construct sealed joints for example be cementing or glueing the joints. Due to the elasticity of the mineral wool there is no need for a plastic joint filler. As the mineral wool further is a poor conductor of heat good insulation properties of the building is obtained.

Transverse-oriented mineral wool, the fibres of which preferably are predominantly oriented perpendicular to the surface compared with normal mineral wool, the fibres of which are oriented in planes parallel with the surface layer, provides a stronger and more weatherproof surface.

The transverse-oriented mineral wool may be produced from mineral fibres, which are collected on a perforated band at the end of a spinning chamber, in which a hardenable bonding agent is atomized. The bonding agent may be a phenolic resin, for example phenol formaldehyde resin, but also flexible forms of phenolic resins, such as latex- or acryl-modified phenolic resins, may be used, as these resins are better suited to withstand the impact from hails or other objects that may hit the facing or covering. The layer of mineral fibres thereafter is compressed and the bonding agent is hardened at the same time and an endless web is formed. The compression should have such an extent that the density of the mineral wool exceeds 50 kg/m$^3$, but in most cases a density exceeding 100 kg/m$^3$ is preferable.

According to a preferred embodiment the fibres are removed from the perforated band of the spinning chamber as an endless web. The fibres within the web lie predominantly within planes which are parallel to the exterior surface of the web. The endless web is cut longitudinally or transversely at distances corresponding to the final thickness of the layer of transverse-oriented mineral wool. The cut-off strips or lamellae are rotated or turned 90°, and the fibres thereafter have an orientation, which is mainly or predominantly perpendicular to the new surface. In particular, the fibres of the transverse-oriented material predominantly lie in planes which are perpendicular to the surface of the material.

It is known that the resistance to compression forces increases in transverse-oriented fibres, as the compression forces are transmitted from the ends of the fibres along the fibres into the body of the mineral wool instead of being transferred by deflection of the fibres as happens in normal mineral wool products, in which the fibres are oriented substantially parallel with the surfaces of the product.

Another and more important advantage of using the transverse-oriented mineral wool products is an improved protection of the bonding of the fibres at their intersections against the ultraviolet rays from the sun.

In practice it has been proved, that unprotected mineral wool products with transverse-oriented fibres have an improved durability and reduces the pollution with fibres to the environment compared with normal, unprotected fibre products.

The invention is further described in the following specification with reference to the drawing, in which examples of building constructions including the exterior facing or covering according to the invention is used.

DETAILED DESCRIPTION OF THE PREFERRED EMBODIMENTS

Figure 1:
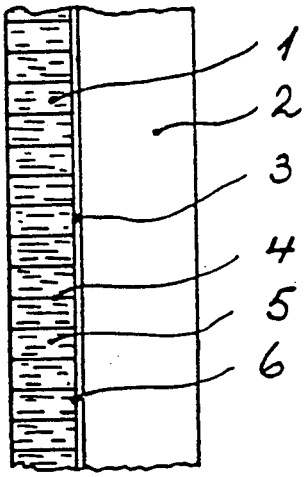
FIG. 1 shows in part of a building, roof or wall, which part on the outside surface is covered by an insulation layer comprising mineral wool slabs with transverse-oriented fibres.

In FIG. 1 a roof or a wall 2 is shown. The wall 2 may be a concrete wall, a wooden wall or any other kind of wall, it is however preferable that its outer surface is comparatively smooth.

The wall 2 is insulated on the outside by means of a prefabricated element 1, which is glued or cemented to the wall 2 by means of a cement or adhesive 3. The element 1 is manufactured by glueing together a number of lamellae 5 in the joints 4. The element may also/or further be reinforced by a more or less thin web 6 for example a glass fibre fleece 6 or another form of support.

The insulation 1 may also be produced by glueing separate lamellae 5 on the wall in situ.

Figure 2:
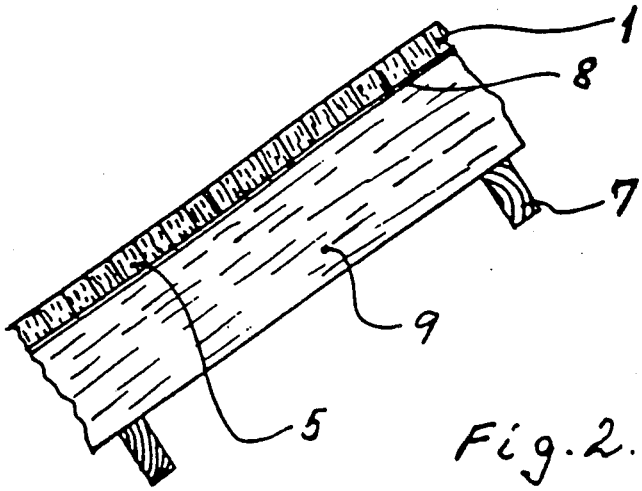
FIG. 2 shows an insulation element in which mineral wool with transverse-oriented fibres is mounted on a base consisting of normal mineral wool.

FIG. 2 another embodiment in which a prefabricated element 1 is mounted on purlins 7. The element 1 is made from lamellae 5 consisting of mineral wool with transverse-oriented fibres, which by means of an adhesive or a glue 8 have been mounted on a support comprising for example a normal slab 9 of mineral wool.

As the resistance to compression of a surface of transverse-oriented mineral wool with a density of 100 $kg/m^3$ is comparable with the resistance to compression of normal mineral wool with a density of 200 $kg/m^3$, it is seen that in order to obtain a specific resistance to compression 50% of the mineral fibres may be saved. On the other hand the insulating properties of transverse-oriented mineral wool is 15% inferior to normal mineral wool with the same density. The saving by using mineral wool with transverse-oriented fibres for covering of facings therefore is 35% plus the advantage of higher resistance to erosion.

When a building construction in consideration of the internal climate also comprise an airtight or vapour impermeable membrane, it should be placed directly on the inside surface of the insulation. The airtight or vapour-impermeable layer may be sprayed or glued on the back of the insulation.

The water-repellant properties of transverse-oriented mineral wool is normally sufficient for ensuring a precipitation-proof roofing if the inclination of the facing or roofing is larger than 30°–40°. If the inclination of the roof is smaller it is preferable to include a watertight membrane in order to prevent undesired penetration of water, and this membrane may in some cases also serve as a vapour-impermeable membrane.

The mineral wool for the insulation preferably has a density of at least 50 $kg/m^3$ and in many cases a density of 100 $kg/m^3$ is preferable. It is possible to compress the slabs to a larger extent and possibly laminate the slabs in order to increase the strength to be sufficient to withstand an increased distance between the supports.

The mineral wool may be dyed during its manufacture with a suitable pigment, or the facing or roofing may be painted after it has been mounted. It is also possible during the manufacture to use raw materials giving dark or possibly black fibres. The properties of the mineral wool may be improved by means of silicone in order to further reduce the rate or erosion, which depending on the climatic cnditions amounts to a fraction of a millimeter per year.

During the manufacture of the lamellae of transverse-oriented mineral wool the knife, saw-blade or cutting jet is preferably moved in a direction, which is perpendicular to the surface of the web of produced mineral wool.

The lamellae may also be produced from stock goods, i.e. mineral wool products which have been cut into slabs and thereafter stored.

I claim:

1. Weather-resistant material for covering a roof, wall, or the like, said weather-resistant material comprising slabs of mineral wool fibers and a bonding agent, said slabs forming a common external surface, said fibers lying predominantly in planes which are perpendicular to said common external surface.

2. Material according to claim 1, wherein said material is water-repellant.

3. Material according to claim 1, wherein said slabs overlap each other.

4. Material according to claim 1, wherein said slabs are butt-jointed to each other.

5. Material according to claim 1, further comprising a support web for supporting said slabs.

6. Material according to claim 5, wherein said support web is formed of glass fiber fleece.

7. Material according to claim 1, wherein the bonding agent is a phenol formaldehyde resin.

8. Material according to claim 1, wherein the bonding agent is a latex- or acryl-modified phenolic resin.

9. Weather-resistant material for covering a roof, wall, or the like, said weather-resistant material being produced by:

(a) cutting slabs from a web of mineral wool fibers and a bonding agent; and (b) orienting said slabs such that said slabs from a common external surface and such that said fibers predominantly lie in planes which are perpendicular to said common external surface.

10. The material of claim 9, wherein said step of orienting said slabs includes rotating said slabs through 90°.

11. The material of claim 9, wherein said web of mineral wool is produced by collecting said mineral wool fibers on a band at the end of a spinning chamber.

12. A weather-resistant system, comprising:

(a) a building; and (b) weather-resistant material covering a portion of said building, said weather-resistant material comprising slabs of mineral wool fibers and a bonding agent, said slabs forming a common surface which is external to said portion of said building, said fibers lying predominantly in planes which are perpendicular to said common external surface.

13. The system of claim 12, wherein said building portion is a wall.

14. The system of claim 12, wherein said building portion is a roof.

15. The system of claim 12, further comprising a support web for supporting said slabs.

16. The system of claim 15, wherein said support web is glued to said building portion.

* * * * *